US006891928B2

(12) United States Patent
Martin et al.

(10) Patent No.: US 6,891,928 B2
(45) Date of Patent: May 10, 2005

(54) LIQUID METAL GASKET IN X-RAY TUBES

(75) Inventors: Thomas Saint Martin, Rochefort en Yvelines (FR); Frédéric Dahan, Le Chesnay (FR)

(73) Assignees: GE Medical Systems; Global Technology Company, LLC, Waukesha, WI (US)

( * ) Notice: Subject to any disclaimer, the term of this patent is extended or adjusted under 35 U.S.C. 154(b) by 35 days.

(21) Appl. No.: 10/430,875

(22) Filed: May 7, 2003

(65) Prior Publication Data

US 2004/0223589 A1 Nov. 11, 2004

(51) Int. Cl.[7] ..... H01J 35/10
(52) U.S. Cl. ..... 378/132; 378/133
(58) Field of Search ..... 378/125–133

(56) References Cited

U.S. PATENT DOCUMENTS 4,856,039 A 8/1989 Roelandse et al.
4,962,519 A 10/1990 Upadhya
5,068,885 A 11/1991 Vetter
5,077,776 A 12/1991 Vetter
5,150,398 A 9/1992 Nishioka et al.
5,169,243 A 12/1992 Takahashi et al.
5,483,570 A 1/1996 Renshaw et al.
5,838,763 A 11/1998 Hiller et al.
6,445,770 B1 9/2002 Wandke et al.
6,636,583 B2 * 10/2003 Ratzmann et al. ..... 378/133

* cited by examiner

*Primary Examiner*—Craig E. Church
*Assistant Examiner*—Jurie Yun
(74) *Attorney, Agent, or Firm*—Christopher L. Bernard, Esq.

(57) ABSTRACT

Liquid metal gaskets for use in vacuum tubes are provided. Such liquid metal gaskets are ideal for use in x-ray tubes in x-ray imaging systems. These liquid metal gaskets comprise an internal plug incorporating a liquid metal filling, a first seal connected to a first end of the internal plug so as to isolate a bearing assembly from a vacuum vessel portion of the vacuum tube, and a second seal connected to a second end of the internal plug so as to prevent particles and vapors in a cavity of the bearing assembly from migrating into a vacuum area of the x-ray tube. The liquid metal gaskets incorporate any suitable liquid metal, such as mercury, gallium, or a gallium alloy. The liquid metal gaskets allow any suitable type of bearing assembly lubricant to be used, such as oils, powders, liquids, solids, wetting metals, and the like.

14 Claims, 3 Drawing Sheets

LIQUID METAL GASKET IN X-RAY TUBES

FIELD OF THE INVENTION

The present invention relates generally to bearing assembly lubricants in vacuum tubes. More specifically, the present invention relates to liquid metal gaskets for use in x-ray tubes that allow any type of bearing assembly lubricant to be used.

BACKGROUND OF THE INVENTION

X-ray tube bearing life is critical to high performance x-ray tube operation. In an x-ray tube, the primary electron beam generated by the cathode deposits a very large heat load in the anode target to the extent that the target glows red-hot in operation. Typically, less than 1% of the primary electron beam energy is converted into x-rays, while the balance is converted to thermal energy. This thermal energy from the hot target is conducted and radiated to other components within the vacuum vessel of the x-ray tube. As a result of these high temperatures caused by this thermal energy, the x-ray tube components are subjected to high thermal stresses that are problematic in the operation and reliability of the x-ray tube.

Typically, an x-ray beam generating device, referred to as an x-ray tube, comprises opposed electrodes enclosed within a vacuum vessel. The vacuum vessel is typically fabricated from glass or metal, such as stainless steel, copper or a copper alloy. As mentioned above, the electrodes comprise the cathode assembly that is positioned at some distance from the target track of the rotating, disc-shaped anode assembly. Alternatively, such as in industrial applications, the anode may be stationary. The target track, or impact zone, of the anode is generally fabricated from a refractory metal with a high atomic number, such as tungsten or a tungsten alloy, or, in mammo tubes, the target track is generally made of molybdenum. Further, to accelerate the electrons, a typical voltage difference of 60 kV to 140 kV (20 kV to 50 kV in mammo tubes) is maintained between the cathode and anode assemblies. The hot cathode filament emits thermal electrons that are accelerated across the potential difference, impacting the target zone of the anode at high velocity. A small fraction of the kinetic energy of the electrons is converted to high energy electromagnetic radiation, or x-rays, while the balance is contained in back scattered electrons or converted to heat. The x-rays are emitted in all directions, emanating from the focal spot, and may be directed out of the vacuum vessel along a focal spot alignment path. In an x-ray tube having a metal vacuum vessel, for example, an x-ray transmissive window is fabricated into the metal vacuum vessel to allow the x-ray beam to exit at a desired location. After exiting the vacuum vessel, the x-rays are directed along the focal spot alignment path to penetrate an object, such as human anatomical parts for medical examination and diagnostic procedures. The x-rays transmitted through the object are intercepted by a detector or film, and an image is formed of the internal anatomy therein. Further, industrial x-ray tubes may be used, for example, to inspect metal parts for cracks, or to inspect the contents of luggage at airports.

Since the production of x-rays in a medical diagnostic x-ray tube is by its nature a very inefficient process, the components in x-ray generating devices operate at elevated temperatures. For example, the temperature of the anode focal spot can run as high as about 2700° C., while the temperature in the other parts of the anode may range up to about 1800° C. Additionally, the components of the x-ray tube must be able to withstand the high temperature exhaust processing of the x-ray tube, at temperatures that may approach approximately 450° C. for a relatively long duration. The thermal energy generated during tube operation is typically transferred from the anode, and other components, to the vacuum vessel.

The high operating temperature of an x-ray tube is problematic for a number of reasons. The exposure of the components of the x-ray tube to cyclic, high temperatures can decrease the life and reliability of the components. In particular, the anode assembly is typically rotatably supported by a bearing assembly. This bearing assembly is very sensitive to high heat loads. Overheating the bearing assembly can lead to increased friction, increased noise, and to the ultimate failure of the bearing assembly.

The choice of bearing assembly lubricant in x-ray tubes is currently very restrained because the lubricant must have a very low vapor pressure at high temperatures (i.e., at or above 400° C.) in order to maintain the vacuum level in the tube. Furthermore, the lubricant must not release any particles into the vacuum that could disturb the high voltage stability therein. Therefore, generally only solid lubricants can be used to lubricate the bearing assemblies in x-ray tubes. Typically, solid lubricants such as silver or lead are used to coat the surfaces of the bearing assemblies. Lead, however, has a low melting point and a high evaporation rate, and therefore is not typically used in bearing assemblies exposed to operating temperatures above 400° C. because the high vacuum may not be able to be maintained. Furthermore, x-ray tubes using solid lead lubricant in the bearing assembly are typically limited to shorter, less powerful exposures. Above 400° C., silver is usually the solid lubricant of choice. Silver allows for longer, more powerful exposures than lead. However, silver is not as preferable as lead because silver has many drawbacks. Silver is much harder than lead and therefore, increases the noise generated by the bearing assembly. Furthermore, silver tends to react with the bearing steel if it becomes too hot, causing grain boundary cracking and premature failure of the bearing. Silver also requires more starting and running torque than lead due to its lower lubricity. Instead of being forced to use solid lubricants such as silver and lead in x-ray tube bearing assemblies, it would be desirable to be able to use various other types of lubricants, such as for example, oil, grease, powder, liquid, wetting metal, or the like. However, this is not currently possible.

As there are presently no suitable x-ray tube bearing assembly systems that allow lubricants other than solid lubricants to be used, it would be desirable to have such systems that would allow for any suitable lubricant to be used, whether solid or not. There is a need for such systems to allow oil, grease, powder, liquid, wetting metal, and other suitable lubricants to be used in the bearing assemblies. Such systems would ideally utilize one or more liquid metal gaskets to prevent the vapor and particles that are generated in the bearing assembly from entering the vacuum portion of the x-ray tube. The liquid metal gaskets of such systems may comprise an internal plug filled with liquid metal, such as mercury, gallium, or a gallium alloy, and may also comprise a first seal and a second seal. Such systems may allow any suitable bearing assembly lubricant to be used, such as for example, oils, greases, powders, liquids, wetting metals, and the like. Many other needs will also be met by this invention, as will become more apparent throughout the remainder of the disclosure that follows.

SUMMARY OF THE INVENTION

Accordingly, the above-identified shortcomings of existing systems and methods are overcome by embodiments of the present invention, which relates to liquid metal gaskets for use in x-ray tube bearing assemblies that allow any type of suitable lubrication to be utilized therein. Embodiments of this invention allow oils, greases, powders, solids, wetting metals, and any other suitable type lubricants to be used in the bearing assemblies of an x-ray tube. This invention comprises one or more liquid metal gaskets being used to prevent the vapor and particles that may be generated in the bearing assembly from entering the vacuum portion of the x-ray tube. These liquid metal gaskets may comprise an internal plug filled with liquid metal, such as mercury, gallium, or a gallium alloy, and may also comprise a first seal and a second seal.

Embodiments of this invention comprise liquid metal gaskets for use in vacuum tubes. These gaskets may comprise: an internal plug comprising a liquid metal filling; a first seal operatively connected to a first end of the internal plug so as to isolate a bearing assembly from a vacuum vessel portion of the vacuum tube; and a second seal operatively connected to a second end of the internal plug so as to prevent particles and vapors in a cavity of the bearing assembly from migrating into the vacuum vessel portion of the vacuum tube. The liquid metal filling in the internal plug may comprise a liquid metal comprising at least one of: mercury, a mercury alloy, gallium, and a gallium alloy. The first seal herein may comprise a contact seal, while the second seal may comprise a non-contact seal.

Embodiments of this invention also comprise x-ray tubes for generating and directing x-rays toward a target along a focal spot alignment path. These x-ray tubes may comprise: a cathode operatively positioned within the x-ray tube to generate electrons; an anode assembly operatively positioned relative to the cathode to generate x-rays when struck by the electrons; and a bearing assembly capable of supporting rotation of the anode assembly relative to the cathode, wherein the bearing assembly comprises at least one liquid metal gasket. Each liquid metal gasket herein may comprise an internal plug, a first seal and a second seal. The internal plug may be filled with a liquid metal comprising at least one of: mercury, gallium, a mercury alloy, and a gallium alloy. The first seal herein may isolate the bearing assembly from a vacuum area of the x-ray tube. The second seal herein may prevent particles and vapors in a cavity of the bearing assembly from migrating into a vacuum area of the x-ray tube. The first seal and the second seal may comprise either a contact seal or a non-contact seal. The liquid metal gaskets in these x-ray tubes allow the bearing assembly to be lubricated by an oil, a grease, a powder, a solid, a liquid, and/or a wetting metal, or any other suitable lubricant.

Embodiments of this invention also comprise an x-ray imaging system. The x-ray imaging system may comprise an x-ray tube for generating and directing x-rays toward a target along a focal spot alignment path, wherein the x-ray tube comprises: a cathode operatively positioned within the x-ray tube to generate electrons; an anode assembly operatively positioned relative to the cathode to generate x-rays when struck by the electrons; and a bearing assembly capable of supporting rotation of the anode assembly relative to the cathode, wherein the bearing assembly comprises at least one liquid metal gasket. Each liquid metal gasket herein may comprise an internal plug, a first seal and a second seal. The internal plug may be filled with a liquid metal comprising at least one of: mercury, gallium, a mercury alloy, and a gallium alloy. The first seal herein may isolate the bearing assembly from a vacuum area of the x-ray tube. The second seal herein may prevent particles and vapors in a cavity of the bearing assembly from migrating into a vacuum area of the x-ray tube. The first seal and the second seal may comprise either a contact seal or a non-contact seal. The liquid metal gaskets in these x-ray tubes allow the bearing assembly to be lubricated by an oil, a grease, a powder, a solid, a liquid, and/or a wetting metal.

Further features, aspects and advantages of the present invention will be more readily apparent to those skilled in the art during the course of the following description, wherein references are made to the accompanying figures which illustrate some preferred forms of the present invention, and wherein like characters of reference designate like parts throughout the drawings.

DESCRIPTION OF THE DRAWINGS

The systems of the present invention are described herein below with reference to various figures, in which.

DETAILED DESCRIPTION OF THE INVENTION

Figure 1:
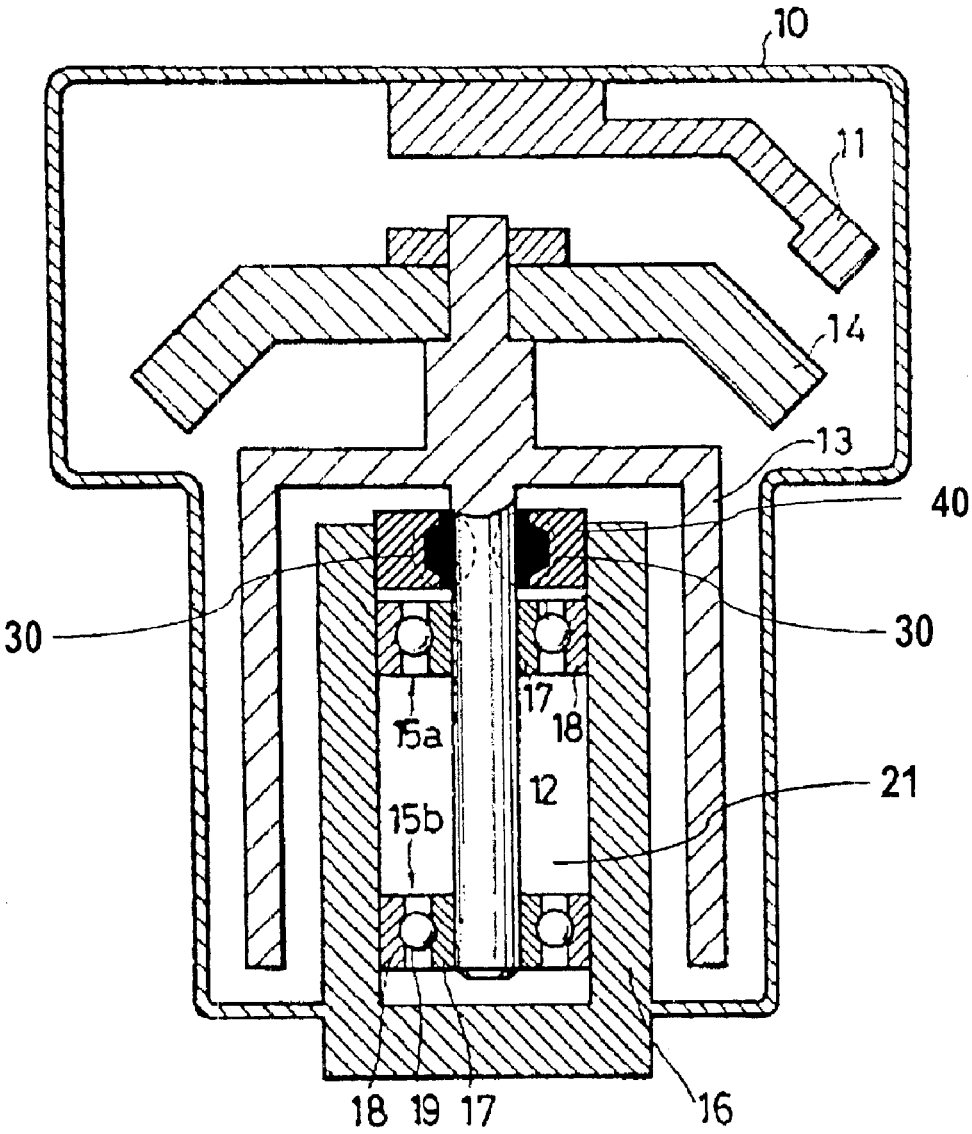
FIG. 1 is a schematic diagram showing an x-ray tube comprising an embodiment of the liquid metal gaskets of this invention.
Figure 2:
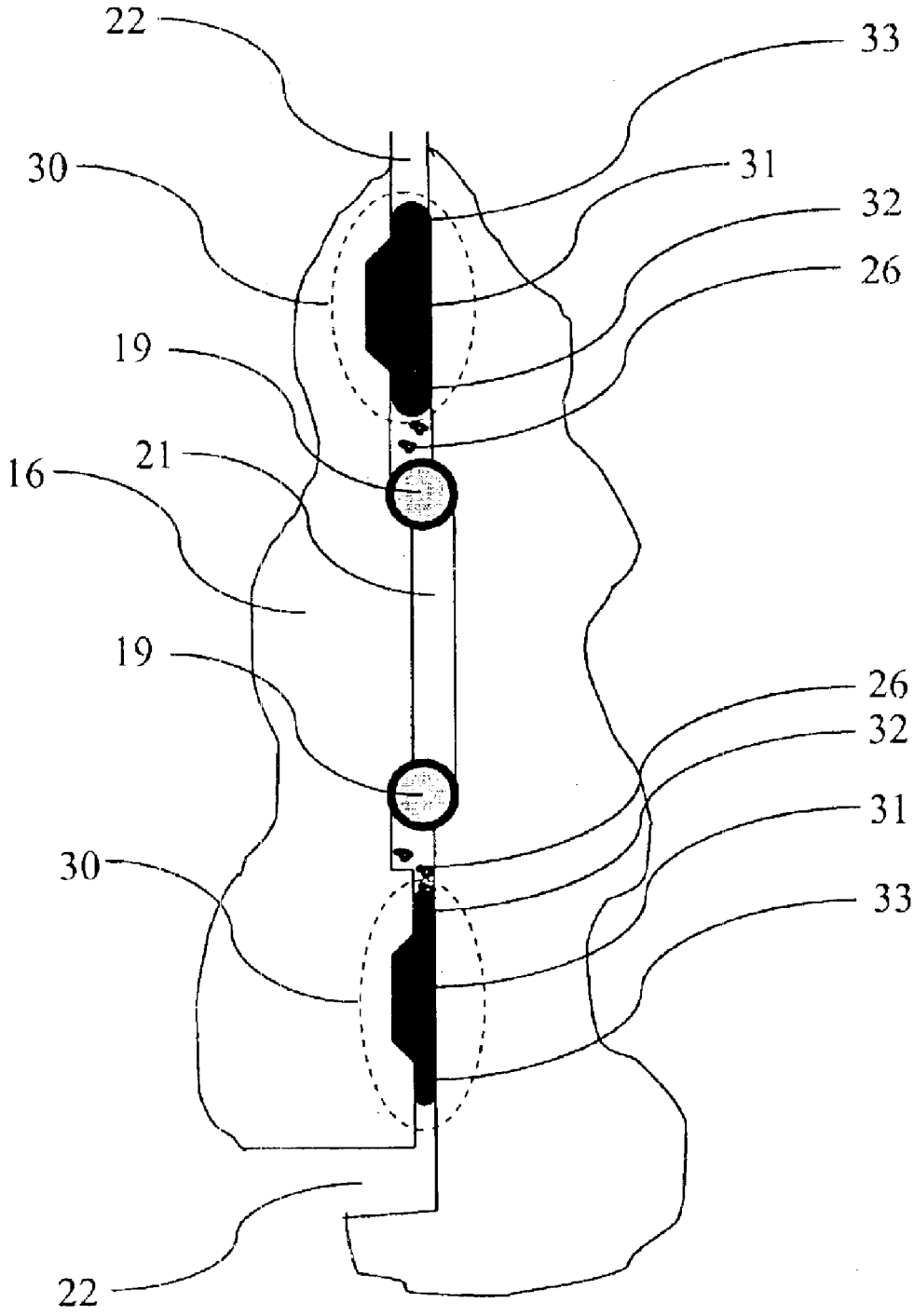
FIG. 2 is a schematic diagram showing a cutaway portion of an x-ray tube comprising two liquid metal gaskets of the present invention.
Figure 3:
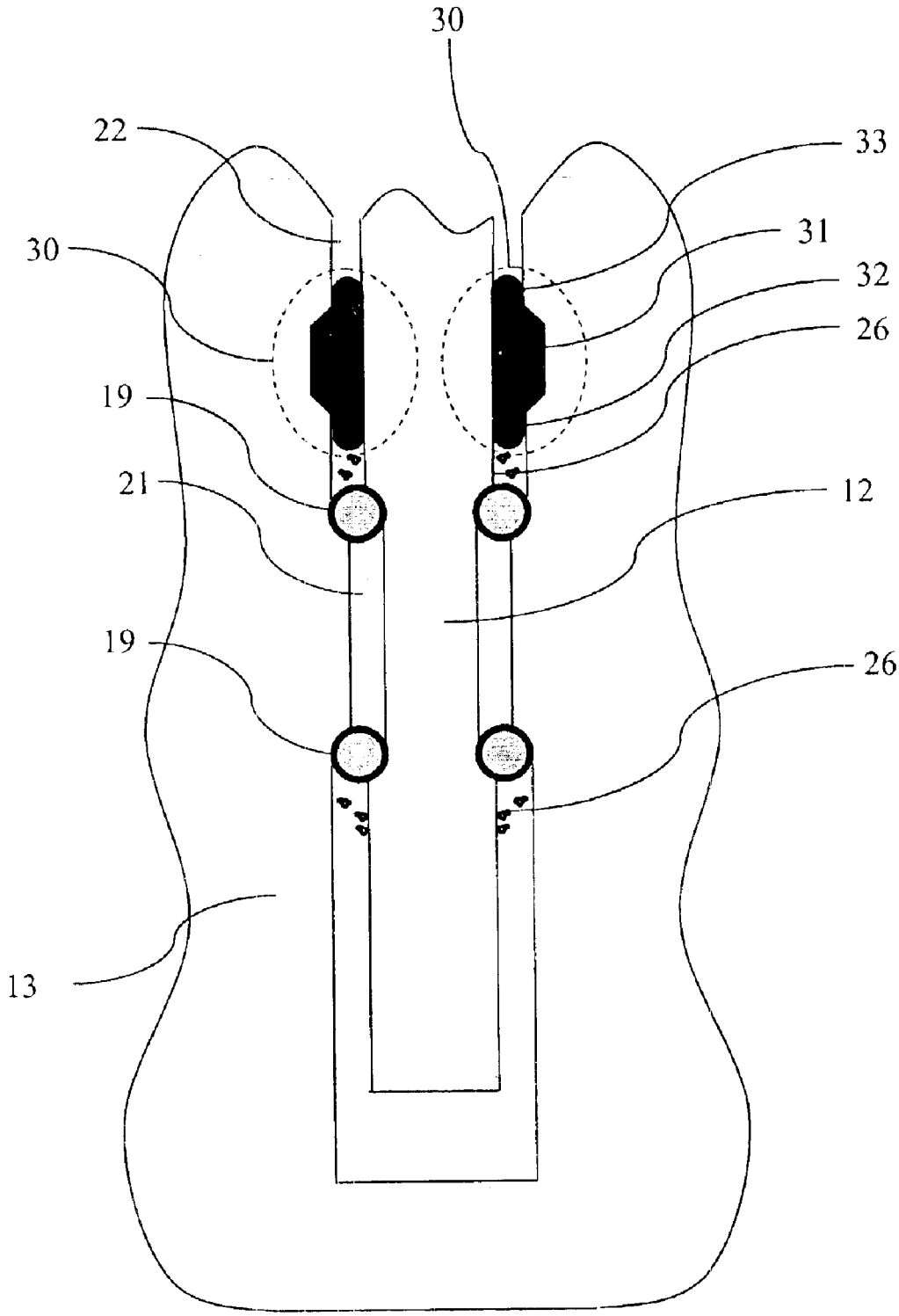
FIG. 3 is a schematic diagram showing a cutaway portion of another x-ray tube comprising two liquid metal gaskets of the present invention.

For the purposes of promoting an understanding of the invention, reference will now be made to some preferred embodiments of the present invention as illustrated in FIGS. 1–3 and specific language used to describe the same. The. terminology used herein is for the purpose of description, not limitation. Specific structural and functional details disclosed herein are not to be interpreted as limiting, but merely as a basis for the claims as a representative basis for teaching one skilled in the art to variously employ the present invention. Any modifications or variations in the depicted support structures and methods of making same, and such further applications of the principles of the invention as illustrated herein, as would normally occur to one skilled in the art, are considered to be within the spirit of this invention.

An x-ray tube comprising an embodiment of the liquid metal gaskets of the present invention is shown in FIG. 1. X-ray imaging systems generally comprise an x-ray tube 20 that comprises: a vacuum envelope 10; an anode assembly including a rotor 13, a rotary shaft 12 fixed to the rotor, and a stator 16; a cathode 11 for emitting electrons; an anode target 14 fixed to the rotary shaft 12 for generating and directing x-rays along a focal spot alignment path; and a bearing structure 15*a*, 15*b* that provides axial and radial support to the rotating anode 14 during operation, all operatively positioned within the vacuum envelope 10. In this embodiment, rotary shaft 12 is rotatably supported by stator 16 through two ball bearing assemblies 15*a*, 15*b*. Each of the ball bearing assemblies 15*a*, 15*b* comprises an inner race 17, an outer race 18, and a plurality of ball bearings 19 rotatably positioned between inner race 17 and outer race 18. A magnetic field generator is disposed outside vacuum envelope 10 to generate a rotating magnetic field that rotates the rotary shaft 12, rotor 13, and anode target 14 at high speed during operation.

There is a vacuum inside the vacuum envelope 10 of about $10^{-5}$ to about $10^{-9}$ torr. When electrons emitted from the cathode 11 hit the anode target 14, x-rays are generated, which heats up the anode target 14 and the inside of vacuum envelope 10. When the anode target 14 and the vacuum envelope 10 are heated to high temperatures, the bearing assemblies 15*a*, 15*b* are also heated due to heat transfer (both radiant and conductive) from rotary shaft 12. To prevent the bearing assemblies 15*a*, 15*b* from seizing up and wearing due to the heat, the frictional surfaces of the ball bearings 19 are generally coated with some sort of lubricant. Additionally, often times even the frictional surfaces of the inner race 17 and outer race 18 are coated with a lubricant too. As previously discussed, since these bearing assemblies 15*a*, 15*b* are utilized under vacuum at high temperatures, solid metal lubricants, such as silver or lead, are generally the only suitable lubricants. However, neither the silver nor the lead is an ideal lubricant for such applications. Lead cannot be optimally used in such applications because, since it has a low melting point and high evaporation rate, a high vacuum may not be able to be maintained in the x-ray tube. Silver also is not ideal because, since silver is much harder than lead, the noise generated by silver lubricated bearing assemblies is greater, and the service life of silver lubricated bearing assemblies may be shorter. Furthermore, silver has several other drawbacks. Silver tends to react with the bearing steel if it becomes too hot, causing grain boundary cracking and premature failing of the bearing. Silver also requires more starting and running torque than lead due to its lower lubricity.

Therefore, it is clear that such solid metal coatings do not adequately dampen the chattering noise of the ball bearings, and are not durable when used at continuously high speeds and temperatures. It would be more desirable to be able to utilize non-solid lubricants, such as oil, grease, powder and the like, instead of the solid metal lubricant. However, modification or redesign of x-ray tubes may be necessary in order to accommodate such non-solid lubricants, because if such lubricant gets into the hermetically sealed vacuum envelope 10 of the x-ray tube, in which there is a strong electric field in the operating state, the x-ray tube could be destroyed.

It would be very desirable to utilize one or more liquid metal gaskets 30 in proximity to the bearing assemblies 15*a*, 15*b* so that non-solid lubricants, such as oil, grease, powder, liquid, wetting metals, and the like, could be used. Such liquid metal gaskets would enable highly efficient bearing lubrication to be utilized, which has beneficial effects on the rotation capability of the x-ray system: rotation speeds may be increased, bearing life may be increased, and noise/vibration may be attenuated.

The liquid metal gasket 30 preferably comprises gallium or a gallium alloy such as GaInSn, but it may also comprise any other suitable liquid metal or alloys thereof having a low enough vapor pressure to seal off the cavities 21 of the rotating anode system. By sealing off the cavities 21 in the rotating anode system, the generation of particles and vapors 26 in the cavities 21 cannot increase the vacuum level in the x-ray tube 20, disturb the high voltage stability thereof, or diminish the image quality of the final x-ray (because particles will not be able to move to the x-ray output window).

The liquid metal gasket 30 may comprise at least one internal plug 31 filled with a liquid metal, such as mercury, a mercury alloy, gallium, or a gallium alloy such as GaInSn, or any other suitable liquid metal. Additionally, each gasket may comprise two seals 32, 33 to prevent the liquid metal from leaking out of the gasket. The first seal 32 may be placed at the boundary of the cavity to isolate the bearing assembly. The first seal 32 is preferably a contact seal, but may also be a non-contact seal. The second seal 33 may be placed at the other end of the gasket to prevent the particles and vapors that are generated in the cavity 21 from migrating into the vacuum area 22 of the x-ray tube 20. The second seal 33 is preferably a non-contact seal (i.e., a clearance or labyrinth seal), but may also be a contact seal. Non-contact seals are preferred in this second seal because they prevent liquid metal from leaking out of the plug by reducing the gap between the rotating and non-rotating parts of the x-ray tube until the viscosity forces are strong enough to keep the fluid contained in the internal plug 23. Furthermore, non-contact seals may be preferred in some instances for thermal and/or mechanical reasons (i.e., heat creation, power loss, reliability, etc.). More than one liquid metal gasket 30 may be used if desired for a given application. Additionally, as shown herein, a liquid metal pool 40 may also be included, if desired.

These liquid metal gaskets 30 seal off the cavities 21 in the rotating anode system, preventing any particles and vapor that may be formed therein from escaping to the vacuum area 22 of the x-ray tube 20. Therefore, these liquid metal gaskets 30 allow any type of lubricant to be used in the bearing assemblies, such as, for example, an oil, a liquid, a powder, a solid, a wetting metal lubricant, or any other suitable lubricant.

In x-ray tubes, the use of lubricants such as oil, grease, powder, wetting metal, and the like, is limited by the evaporation rate of the material, and by the particles released therefrom. The liquid metal gaskets 30 of this invention provide a physical boundary for the vapors and particles that are generated during use of the x-ray tube, preventing them from escaping into the vacuum portion of the x-ray tube. These gaskets also ensure good thermal and/or electrical contact between the stationary and the rotating parts of the x-ray tube.

As described above, the liquid metal gaskets of this invention allow high performance bearings to be realized. Advantageously, these liquid metal gaskets allow any type of bearing lubricant to be used in x-ray imaging systems, not just solid lubricants such as silver and lead.

Various embodiments of this invention have been described in fulfillment of the various needs that the invention meets. It should be recognized that these embodiments are merely illustrative of the principles of various embodiments of the present invention. Numerous modifications and adaptations thereof will be apparent to those skilled in the art without departing from the spirit and scope of the present invention. For example, while using these liquid metal gaskets in x-ray imaging systems has been described, these gaskets could be used in a variety of other systems comprising vacuum tubes. Furthermore, while using these liquid metal gaskets in ball bearing assemblies has been described herein, these gaskets could be used in a variety of other bearing assemblies. Thus, it is intended that the present invention cover all suitable modifications and variations as come within the scope of the appended claims and their equivalents.

What is claimed is:

1. An x-ray tube for generating and directing x-rays toward a target along a focal spot alignment path, the x-ray tube comprising:

a cathode operatively positioned within the x-ray tube to generate electrons;

an anode assembly operatively positioned relative to the cathode to generate x-rays when struck by the electrons; and a bearing assembly capable of supporting rotation of the anode assembly relative to the cathode, wherein the bearing assembly comprises at least one liquid metal gasket, wherein the at least one liquid metal gasket comprises an internal plug, a first seal, and a second seal.

2. The x-ray tube of claim 1, wherein the internal plug is filled with a liquid metal comprising at least one of: mercury, gallium, a mercury alloy, and a gallium alloy.

3. The x-ray tube of claim 1, wherein the first seal isolates the bearing assembly from a vacuum area of the x-ray tube.

4. The x-ray tube of claim 1, wherein the first seal comprises at least one of: a contact seal and a non-contact seal.

5. The x-ray tube of claim 1, wherein the second seal prevents particles and vapors in a cavity of the bearing assembly from migrating into a vacuum area of the x-ray tube.

6. The x-ray tube of claim 1, wherein the second seal comprises at least one of: a non-contact seal and a contact seal.

7. The x-ray tube of claim 1, wherein the bearing assembly is lubricated by at least one of: an oil, a grease, a powder, a solid, a liquid, and a wetting metal.

8. An x-ray imaging system, comprising:

an x-ray tube for generating and directing x-rays toward a target along a focal spot alignment path, the x-ray tube comprising;

a cathode operatively positioned within the x-ray tube to generate electrons;

an anode assembly operatively positioned relative to the cathode to generate x-rays when struck by the electrons; and a bearing assembly capable of supporting rotation of the anode assembly relative to the cathode, wherein the bearing assembly comprises at least one liquid metal gaskets, wherein the at least one liquid metal gasket comprises an internal plug, a first seal, and a second seal.

9. The x-ray imaging system of claim 8, wherein the internal plug is filled with a liquid metal comprising at least one of: mercury, gallium, a mercury alloy, and a gallium alloy.

10. The x-ray imaging system of claim 8, wherein the first seal isolates the bearing assembly from a vacuum area of the x-ray tube.

11. The x-ray imaging system of claim 8, wherein the first seal comprises at least one of: a contact seal and a non-contact seal.

12. The x-ray imaging system of claim 8, wherein the second seal prevents particles and vapors in a cavity of the bearing assembly from migrating into a vacuum area of the x-ray tube.

13. The x-ray imaging system of claim 8, wherein the second seal comprises at least one of: a non-contact seal and a contact seal.

14. The x-ray imaging system of claim 8, wherein the bearing assembly is lubricated by at least one of: an oil, a grease, a powder, a solid, and a liquid.

* * * * *